US005676769A

United States Patent [19]

Kawamura et al.

[11] Patent Number: 5,676,769

[45] Date of Patent: Oct. 14, 1997

[54] GAS CARBURIZING PROCESS AND AN APPARATUS THEREFOR

[75] Inventors: Toshiyuki Kawamura; Hitoshi Goi; Atsushi Murayama; Hirofumi Kamisugi, all of Hamamatsu, Japan

[73] Assignee: Dowa Mining Co. Ltd., Tokyo, Japan

[21] Appl. No.: 588,781

[22] Filed: Jan. 19, 1996

[30] Foreign Application Priority Data

Jan. 20, 1995 [JP] Japan ..... 7-026144

[51] Int. Cl.[6] ..... C21D 1/06; C23C 8/20

[52] U.S. Cl. ..... 148/206; 148/235; 148/233

[58] Field of Search ..... 266/251, 252; 148/206, 235, 233

[56] References Cited

U.S. PATENT DOCUMENTS 4,415,378 11/1983 McKinney et al. ..... 148/233

4,950,334 8/1990 Nishioko et al. ..... 148/235

5,133,813 7/1992 Nanba et al. ..... 148/235

*Primary Examiner*—Deborah Yee

*Attorney, Agent, or Firm*—Michael D. Bednarek; Kilpatrick Stockton LLP

[57] ABSTRACT

A treating material W pre-heated to a carburizing temperature of 750°–950° C. is heat-treated in a carburizing atmosphere directly supplied with hydrocarbon and oxidizing gases and heated to 1000°–1100° C. Then, the treating material W is forcibly cooled to a temperature below 600° C., the treating material W is re-heated to 750°–850° C., and then it is hardened.

Energy required to the carburization can be saved because drastic reduction of the treating time is possible.

5 Claims, 5 Drawing Sheets

GAS CARBURIZING PROCESS AND AN APPARATUS THEREFOR

FIELD OF THE INVENTION

This invention relates to a gas carburizing process and an apparatus therefor.

BACKGROUND OF THE INVENTION

In a conventional gas carburizing process being commonly employed today, the heat treatment has been conducted at 900°–930° C. using carburizing gas formed in a transforming furnace.

A new gas carburizing process has been proposed by the applicant of this invention (Japanese Patent Publication No. 38870/1989, Japanese Patent Publication No. 51904/1994, etc.) intending to improve economics by eliminating manufacturing process of the carburizing gas in the transforming furnace and by directly supplying both hydrocarbon and oxidizing gases as raw gas into the furnace.

The treating temperature of 900°–930° C. used in the conventional gas carburizing process was set considering prevention of coarse crystal grain formation in the treating material and efficiency of treating time.

That is, when the treating temperature is set at a temperature exceeding the upper limit of 900°–930° C., even though required carburized layer can be obtained in a short time, but obtaining satisfactorily carburized structure is very difficult due to formation of coarse crystal grain in the treating material. On the other hand, when the treating temperature is below the lower limit of 900°–930° C., it takes long time to obtain a required carburized depth although good carburized structure is obtained.

Shortening of the treating time in gas carburization contributes greatly to cost saving by reduction of energy consumption such as power and gas.

An object of the present invention is to provide a gas carburizing process and an apparatus therefor which is excellent in economics without reducing quality of the product.

In order to achieve the aforementioned object, shortening of the treating time is proposed by the invention. Furthermore, a transforming furnace or formation of carburizing gas in a carburizing furnace is not required in the present invention.

In the gas carburizing process according to the present invention, a treating material pre-heated to a carburizing treatment temperature of 750°–950° C. is heat-treated in a carburizing atmosphere directly supplied with hydrocarbon and oxidizing gases and then pre-heated to 1000°–1100° C.

According to the present invention, unlike to the prior art method wherein the heat-treatment is carried out in a carburizing atmosphere supplied with the carburizing gas and heated to 1000°–1100° C., the carburizing atmosphere is directly produced in the furnace. The carburizing atmosphere produced directly in the furnace is highly reductive. Thus, grain boundary oxidation is very low. Further, heating energy (gas sensible heat) can be saved due to elimination of the carburizing gas. Furthermore, a variation of the carburized layer and the carburizing time can be reduced.

In the gas carburizing process according to the present invention, following the aforementioned step the treating material is preferably cooled to temperature below 600° C., heated again to 750°–850° C. and then subjected to a laminar flow hardening.

Following these steps, coarse crystal grains formed by the high-temperature carburization can be regulated to specified grain sizes during cooling and re-heating steps so as to further reduce grain boundary oxidation. Furthermore, it can be easily attained to crystallize carbides homogeneously in order to improve the wear resistance and fatigue strength etc., and the product having equal or even higher quality than the prior art product can be provided.

Further, because the laminar flow hardening is used, a superior quality product having less hardening distortion can be produced in a short time.

A gas carburizing apparatus according to the present invention comprises a preheating chamber in where the treating materials are preheated to 750°–950° C., a carburizing chamber in where hydrocarbon and oxidizing gases are directly supplied to and heated to 1000°–1100° C., a cooling chamber in where carburized materials are cooled to temperature below 600° C., a reheating chamber in where cooled materials in the cooling chamber are re-heated to 750°–850° C., a quenching chamber, and a purge chamber. Each chamber has its own transfer means to transfer treated materials to the next chamber. Said each chamber is connected in series through a opening/closing door. Preferably, said hardening chamber is constructed as a laminar flow hardening chamber.

Employing the gas carburizing apparatus according to the present invention, said process of the present invention can be effectively implemented.

DETAILED DESCRIPTION OF THE INVENTION

Figure 1:
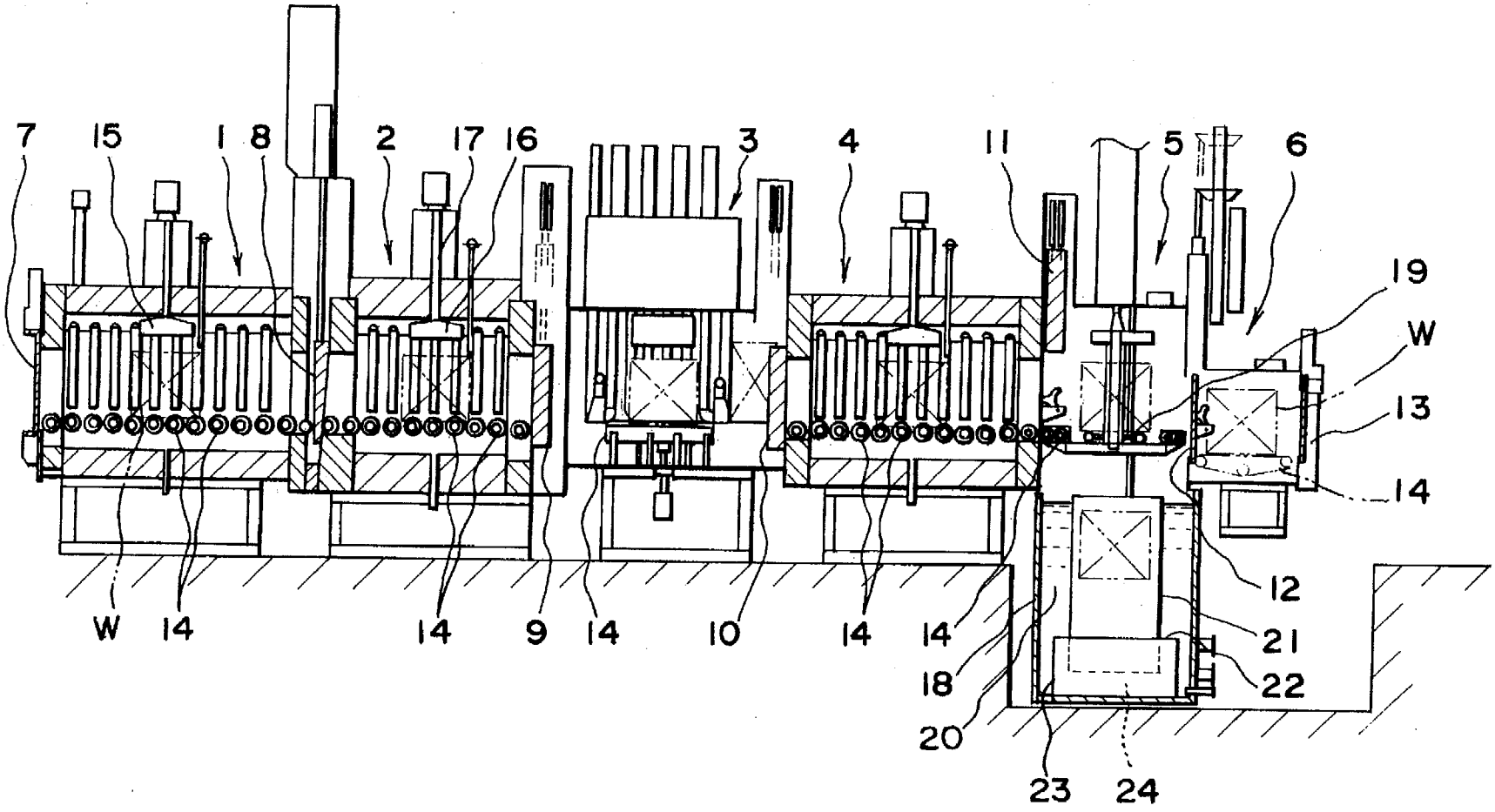
FIG. 1 is a vertical side section view of main part of the gas carburizing process according to the present invention.

In drawings, numeral 1 is a preheating chamber, 2 is a carburizing chamber, 3 is a cooling chamber, 4 is a re-heating chamber, 5 is a hardening chamber, and 6 is a purge chamber.

Further, in drawings, numeral 7 is an inlet door, 8 to 12 are opening/closing doors, respectively, 13 is an exit door, 14*s* are the transfer means provided to said each chamber, and W is a treating material.

In the pre-heating chamber 1, the treating material is preheated from room temperature up to the carburizing temperature commonly used, that is, 750°–950° C., preferably 930° C. Construction of the preheating chamber 1 is basically similar to a heating chamber of conventional batch furnace. In the preheating chamber 1, it is possible to stop a fan 15 at initial supply phase or to shot-purge to protect initial atmosphere.

Further, the pre-heating chamber 1 is constructed so as to enable to control the temperature rising curve so that no distortion due to thermal stress is occurred in the treated material W during the temperature rising process.

In the carburizing chamber 2, the treating material that is transferred from the heating chamber 1 by the transfer means 14 through opened opening/closing door 8 is heated up to a suitable temperature of higher than 1000° C., in particular to 1050° C., and is carburized simultaneously by supplying hydrocarbon gas (methane, propane, butane etc.) and oxidizing gas (pure oxygen, air, carbon dioxide etc). Entire apparatus installed in the carburizing chamber 2, such as the transfer means 14, a fan 16, a fan shaft 17, opening/closing doors 8 and 9 etc. are constructed of high temperature resisting materials.

In the carburizing chamber 2, the carburization can reach to a targeted effective depth in a short time because a diffusion coefficient of carbon is as high as twice of prior art, due to higher carburizing temperature than that of the prior art.

In the cooling chamber 3, the heated material W up to 1050° C. in the carburizing chamber 2 is forcibly cooled to temperature below 600° C., preferably to 500° C. In the cooling chamber 3, a cooling method utilizing latent heat of boiling of water (refer to Japanese Patent Appln. Laid Open No. 255619/1989 applied by this applicant), a gas cooling method utilizing of highly pressed (about 5 kg/cm$^2$) nitrogen or carbon dioxide gas flow, a convection cooling method by cooled scirocco fan etc. are used jointly.

In the re-heating chamber 4, the treating material W cooled to 500° C. in the cooling chamber 3 is re-heated up to an austenitizing temperature of 850° C. When it is necessary, ammonia gas can be fed into the re-heating chamber 4 to reduce surface irregular layer and to improve resistance to tempering softening. Also, similar to the pre-heating chamber 1, the re-heating chamber 4 is constructed so as to enable to control a temperature rising curve so that no distortion by thermal stress is occurred in the treating material W during the temperature rising process.

In the re-heating chamber 4, coarse crystal grains-formed by high temperature carburization in the carburizing chamber 2 are regulated to the specified size during cooling process in the cooling chamber 3 and by the re-heating process in the re-heating chamber 4.

In the hardening chamber 5, there is provided with a quenching vessel 18 and an elevator 19 as conventional method.

Figure 2:
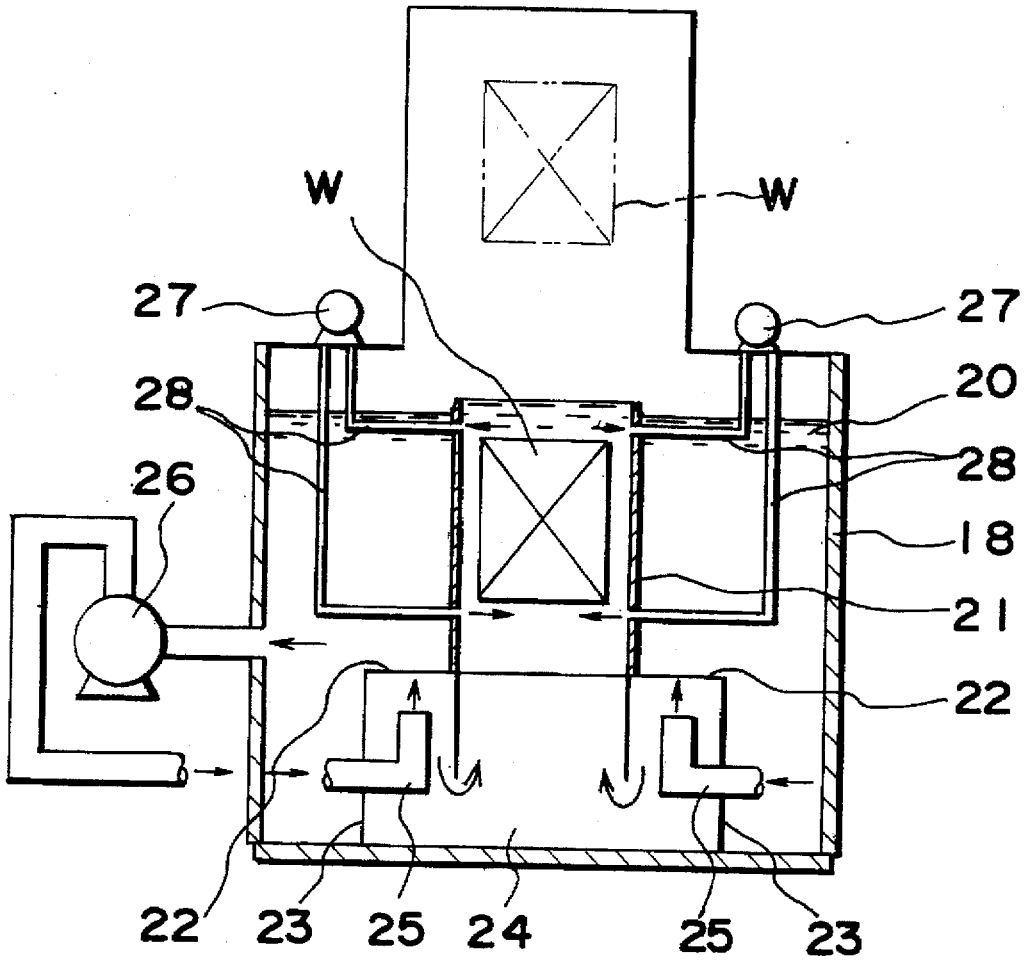
FIG. 2 is a schematic vertical section view of the hardening chamber.

Instead of agitation of quench oil 20, however, laminar flow hardening shown in FIG. 2 is utilized in the hardening chamber 5.

A hardening frame 21 to receive a descending elevator 19 is disposed in approximately middle of the quenching vessel 18. A horizontal dynamic pressure eliminating plate 22 is disposed a slightly downward of the middle of upper and lower ends of outer periphery of the quenching frame 21. A vertical partition 23 is disposed between peripheral rim of the dynamic pressure eliminating plate 22 and bottom of the quenching vessel 18. The vertical partition 23 supports the quenching frame 21 through the dynamic pressure eliminating plate 22. The low end of the quenching frame 21 does not contact with the bottom of the quenching vessel 18. A sub-chamber 24 is formed under the quenching frame 21 by the vertical partition 23 and the dynamic pressure eliminating plate 22.

Suitable number of guide pipes 25 penetrate in the vertical partition 23 with the same intervals each other. Inner openings of the guide pipes 25 are bent towards the dynamic pressure eliminating plate 22, that is upwards. The quench oil 20 in the quenching vessel 18 is equally supplied to the guide pipes 25 through a blow-up pump 26.

Numeral 27 in FIG. 2 is a circulation pump to circulate the quench oil 20 in the upper and lower position of the quenching frame 21, and 28 is a circulating pipe therefor.

In the aforementioned construction, the quench oil 20 in the quenching vessel 18 is supplied into the sub-chamber 24 through the guide pipes 25 by operation of the blow-up pump 26. The quench oil 20 supplied into the sub-chamber 24 collides with the dynamic pressure eliminating plate 22, and converts into laminar flow that flows in layers without any eddies (laminar flow), and then flows into the quenching frame 21 from its lower end. The treating material W descends into the inside of the quenching frame 21 by the elevator 19. The treating material W is cooled there by the quench oil 20 flowing into the quench frame 21.

It is said that the principle of the hardening is to perform quickly but slowly. Particularly in order to perform hardening perfectly with less distortion, the treating material W should be cooled down rapidly until temperature of the treating material W reaches so-called nose point of the S-curve and kept thereafter at Ms point (about at 210° C.) for a while to equalize the temperature outside and inside of the treating material W before proceeding to martensitic transformation.

Homogeneous hardening without any irregularity can be attained in the laminar flow hardening chamber 5 because, unlike the prior art using agitation with blades, no bubbles are generated in the quench oil, and no turbulent flow, such as flow of quench oil toward less inner resistance is generated.

Figure 3:
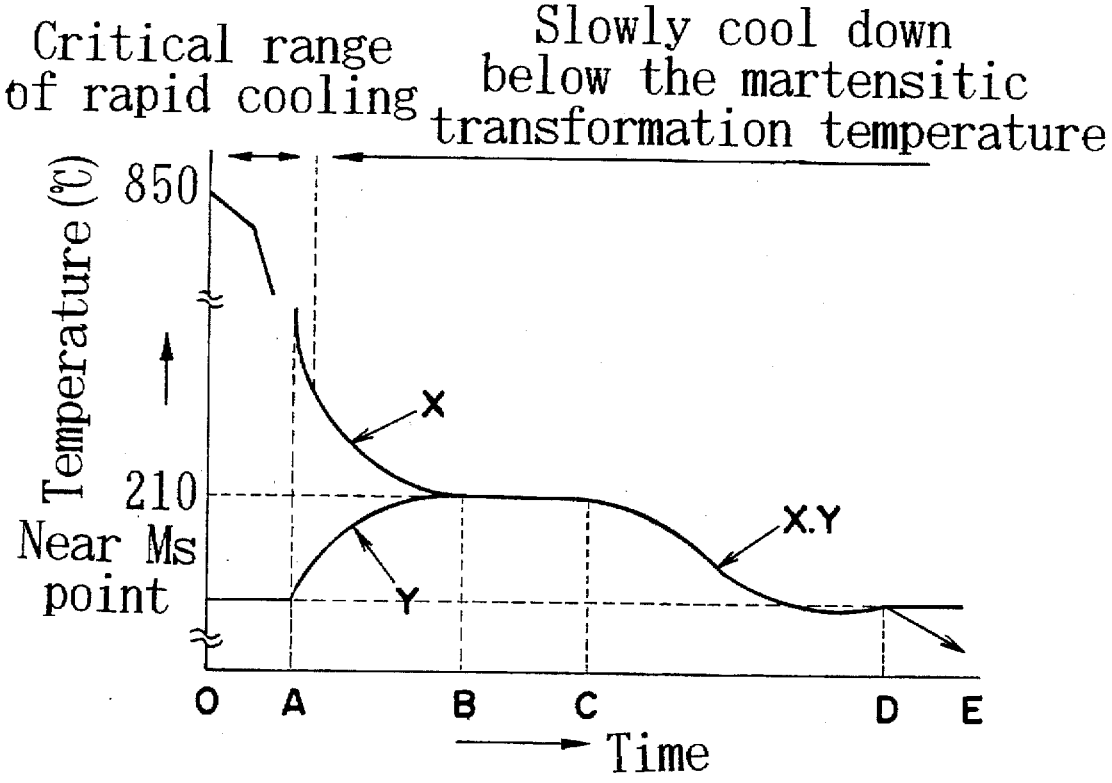
FIG. 3 is a graph showing temperature of the treating material and temperature of the quench oil during hardening.

FIG. 3 shows an example of temperature curve X of the treating material W and temperature curve Y of the quench oil during the actual hardening process in the hardening chamber 5 having said construction.

In FIG. 3, the range between O and A in time axis is a so-called critical range in where the treating material W is to be cooled quickly by operating the blow-up pump 26.

The range between A and B is a relatively slow cooling process of the treating material W after stopping the blow-up pump 26. That is, when the blow-up pump 26 is stopped, temperature of the quench oil 20 rises due to heat generated from the treated material W. Therefore, the treated material W is cooled down slowly.

The range between B and C is a process to decrease temperature difference between upper and lower part of the treated material W by operating the circulation pump 27. The circulation pump 27 supplies the quench oil in the quenching frame 21, sucking from upper part and supplying to lower part.

Thus, the quench oil in the quenching frame 21 circulates vertically and make less temperature difference between the upper and lower part of the treated material W.

The range between C and D is a process to enhance martensitic transformation by decreasing the temperature of the treated material W and the temperature of the quench oil 20 by re-start of the blow-up pump 26. The range between D and E is a slinger process.

An invertor is used to operate the blow-up pump 26 to enable changing flow velocity by setting its frequency at a suitable value. Operation time of the blow-up pump 26 can be set at predetermined time using a timer.

In the purge chamber 6 adjacent to the hardening chamber 5, nitrogen or carbon dioxide gas can be purged so as to form curtain frame during transportation of the treated material W.

Figure 4:
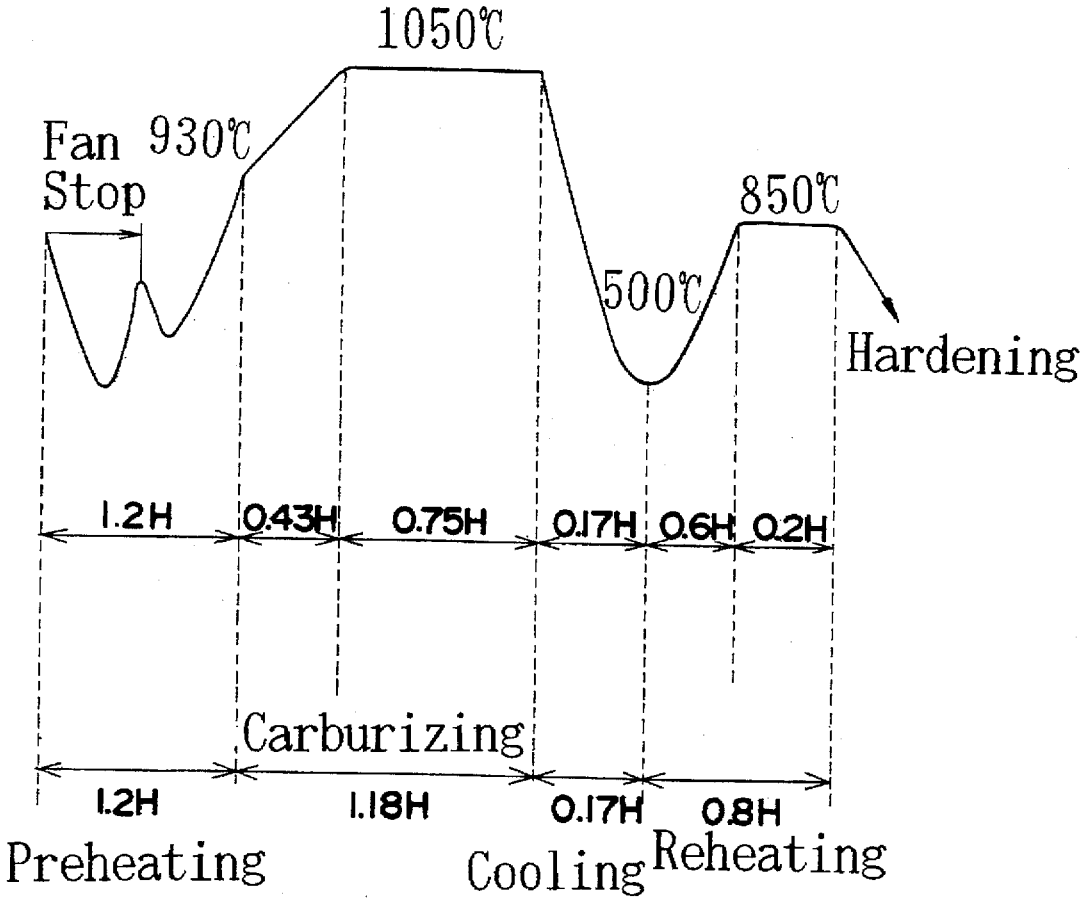
FIG. 4 is a chart showing a pattern of carburizing process according to the present invention.

FIG. 4 shows a pattern of actual carburizing treatment using the aforementioned gas carburizing apparatus.

Gross weight 300 kg of the treating material W is pre-heated up to 930° C. in 1.2 hours in the pre-heating chamber 1. At initial stage following charging of the treating material W, heating was controlled by stopping the fan 15 and shot purge with butane was made.

Then, the treating material W pre-heated to 930° C. was transferred to the carburizing chamber 2 to heat up to 1050° C. in 0.43 hour and to carry out carburization treatment in 1.18 hours in a carburizing atmosphere comprising butane supplying at the flow rate of 1–5 l/min. as hydrocarbon gas and carbon dioxide at the flow rate of 0.5–2.0 l/min. as oxidizing gas.

Thereafter, the treated material W was cooled down to 500° C. in 0.17 hour in the cooling chamber 3, then re-heated to the preferable hardening temperature of 850° C. in 0.6 hour in the re-heating chamber 4, followed by hardening with said laminar flow method resulted in a carburized layer of more than 1.3 mm thick.

Total time required for the carburization including hardening is 3.35 hours, and so-called cycle time corresponds to the longest staying time, that is, the pre-heating time of 1.2 hours. Therefore, hourly production rate is 300 kg/1.2 hour= 250 kg/hour.

Figure 5:
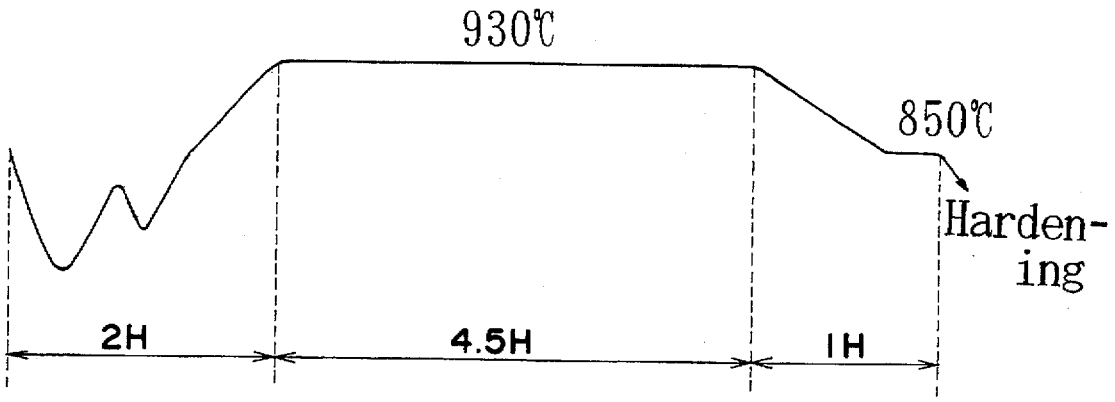
FIG. 5 is a chart showing a pattern of carburizing process according to prior art.

A common carburizing treatment pattern of prior art process (carburizing temperature: 930° C.) is shown in FIG. 5 to compare with the carburizing process according to the present invention.

In this reference, carburizing treatment using 550 kg of treating material was performed in a batch furnace. The treating material W and the carburizing atmosphere in this reference were the same as those used in the present invention. Total time required for the carburization process to hardening in this reference was 7.5 hours, and the hourly production rate was 550 kg/7.5 hours=73 kg/hour.

Compared hourly production rates between two processes, it came up with 250 kg/73 kg=3.4, therefore the hourly production efficiency for the carburizing process according to the present invention was 3.4 times higher. That means that the treatment time can be reduced. Since gas consumption is decreases by reducing the treatment time, the carburizing process according to the present invention is more economical.

By increasing tray components in the pre-heating chamber, carburizing chamber and re-heating chamber in the case of the present invention, the hourly production rate can be further increased. As heating media, either electric power or gas can be used.

Further, grain boundary oxidation of SCM420-type material was 20–25 μm in the reference shown in FIG. 5, but it could be reduced to less than 15 μm in the example according to the present invention shown in FIG. 4.

What we claim is:

1. A gas carburizing process characterized in that the treating material is pre-heated to a temperature of 750°–900° C. in a carburizing atmosphere directly supplied with hydrocarbon and oxidizing gas and then heated up to a carburizing temperature of 1,000°–1,100° C. in a carburizing atmosphere directly supplied with hydrocarbon and oxidizing gas.

2. A gas carburizing process comprising the steps of:

preheating the treating material to a temperature of 750°–900° C. in a carburizing atmosphere directly supplied with hydrocarbon and oxidizing gas;

heating the treating material up to a carburizing temperature of 1,000°–1,100° C. in a carburizing atmosphere directly supplied with hydrocarbon and oxidizing gas;

forcibly cooling the treating material to a temperature below 600°;

re-heating the treating material to 750–850° and hardening it.

3. A gas carburizing process described in claim 2 wherein hardening is made by a laminar flow of quench oil.

4. A carburizing apparatus comprises a pre-heating chamber in where treating material is pre-heated to 750°–950° C., a carburizing chamber in where hydrocarbon and oxidizing gases are directly supplied and heated to 1000°–1100° C., a cooling chamber in where the treated material after carburization is forcibly cooled to a temperature below 600° C., a re-heating chamber in where the treated material cooled in the cooling chamber is re-heated to 750°–850° C., a hardening chamber, and a purge chamber, wherein each of these chambers has own transfer means, and being connected in series through a opening/closing door.

5. A carburizing apparatus described in claim 4 wherein the hardening chamber is constructed as a laminar flow hardening chamber.

* * * * *